US005199225A

United States Patent [19]

Esposito

[11] Patent Number: 5,199,225

[45] Date of Patent: Apr. 6, 1993

[54] BLADE SHARPENING GUIDE

[76] Inventor: Renato Esposito, 18700 SW. 84th Crt., Miami, Fla. 33157

[21] Appl. No.: 921,227

[22] Filed: Jul. 29, 1992

[51] Int. Cl.[5] ..... B24B 3/54

[52] U.S. Cl. ..... 51/214; 51/241 R; 51/241 G

[58] Field of Search ..... 51/214, 241 G, 241 R, 51/241 S, 211 R, 211 H

[56] References Cited

U.S. PATENT DOCUMENTS

| | | | |
|---|---|---|---|
| 880,765 | 3/1908 | Utter . | |
| 1,103,427 | 7/1914 | Neider . | |
| 1,797,589 | 3/1931 | Price . | |
| 1,829,061 | 10/1931 | Rhodes . | |
| 2,542,472 | 2/1951 | Brinkley | 51/214 |
| 2,782,570 | 2/1957 | Ische | 51/122 |
| 3,088,252 | 5/1963 | Schmidt | 51/218 |
| 3,882,642 | 5/1975 | Sykes | 51/214 |
| 4,509,268 | 4/1985 | Marquam et al. | 51/214 |
| 4,991,357 | 2/1991 | Stickles, Sr. | 51/214 |

*Primary Examiner*—M. Rachuba
*Attorney, Agent, or Firm*—Alvin S. Blum

[57] ABSTRACT

A sharpening guide is provided for manual sharpening of a blade at a fixed angle on a sharpening stone. The guide is an elongate, wedge-shaped strip coated on one face with adhesive. It is removably adhered to one face of a blade to be sharpened. The second face of the wedge is held flat against the sharpening stone and the angle of the wedge maintains a fixed angle for grinding the edge of the blade. The guide is removed by lifting by a release tab extending from the back of the wedge and it is then stuck on the second face of the blade to sharpen the second side of the blade. The strip is provided in straight form and in curved form. Appropriate lengths are broken off to suit a particular blade configuration. The guide may be provided in various angles of wedge and various radii of curvature. The strip may be provided in materials that do not readily grind off and load the abrading surface. Optionally, the strip is made of a material which is readily washed off the sharpening stone if it becomes loaded.

12 Claims, 1 Drawing Sheet

FIG. 1
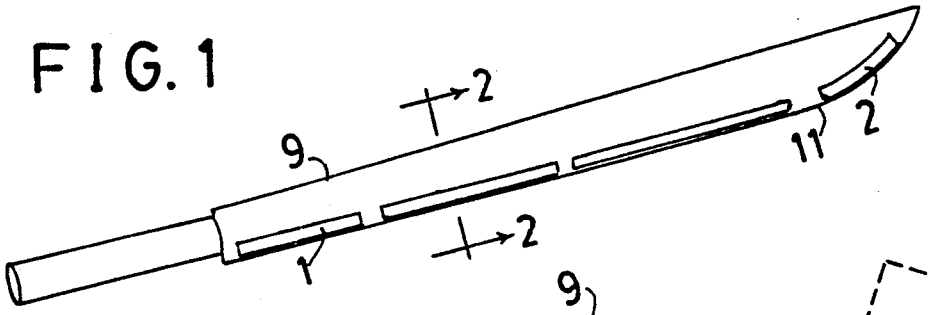
FIG. 2
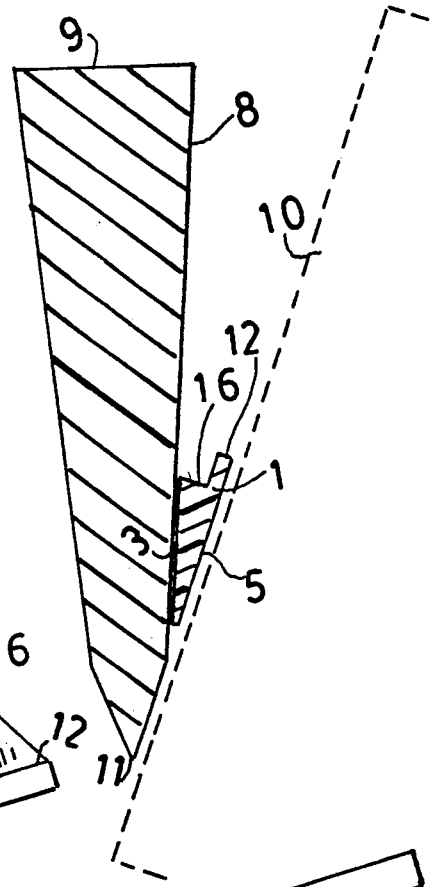
FIG. 3
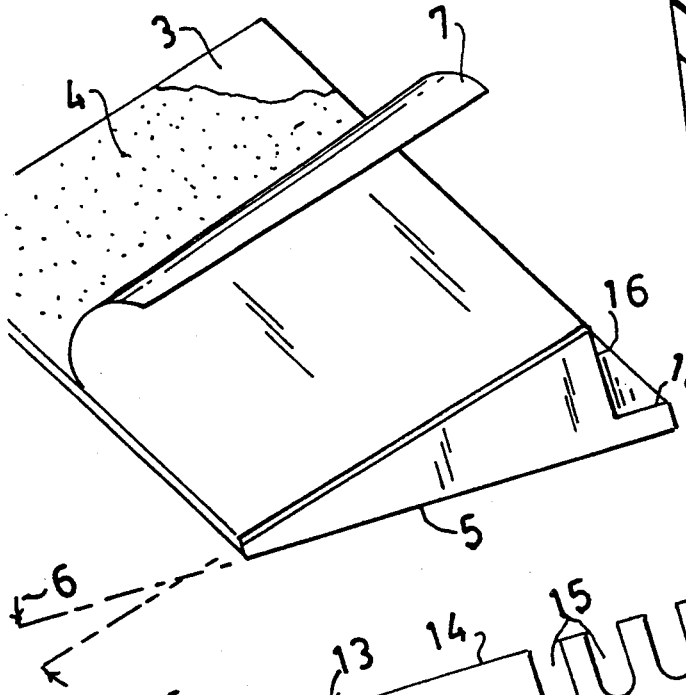
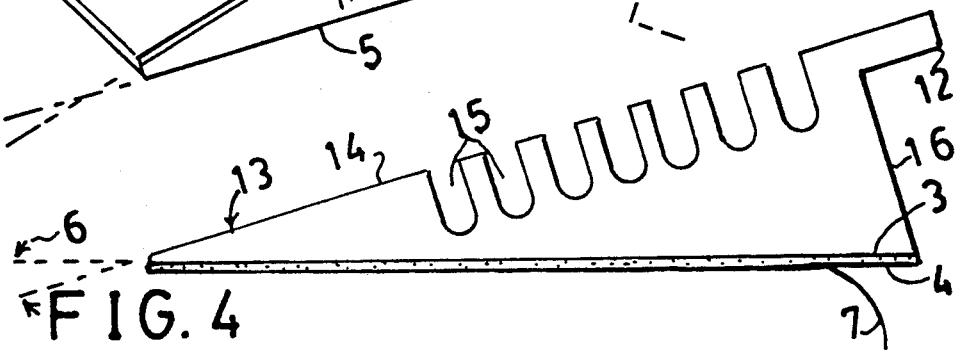
FIG. 4

BLADE SHARPENING GUIDE

FIELD OF THE INVENTION

This invention relates to means for sharpening cutting blades and more particularly to devices that fasten to blades to ensure that a blade is sharpened at a correct cutting angle.

BACKGROUND OF THE INVENTION

Cutting blades are ground and sharpened at angles that are optimized for particular purposes. When the blade becomes dulled by use, the user may resharpen the blade manually using a sharpening stone. The blade is rubbed on the stone to restore the original angle and edge configuration. This requires great skill in holding the blade at the correct angle during the process. Various devices have been provided to ensure that the correct angle is provided. They generally clamp onto the back of the blade and provide a planar surface to lay against the grinding surface at the correct angle. They are exemplified by the following U.S. Patents:

U.S. Pat. No. 880,765 issued Mar. 3, 1908 to Utter
U.S. Pat. No. 2,782,570 issued Feb. 26, 1957 to Ische
U.S. Pat. No. 1,103,427 issued Jul. 14, 1914 to Neider These are generally sturdily constructed so that they clamp firmly in position and resist dislodging by the grinding action. Unfortunately, the surface that lies against the grinding surface becomes ground down with use, so that the angle changes. Another problem presented by the grinding guides of the prior art is that they are generally not useful for the curved tip of certain blades, and they are of limited length, so that they are not useful for long blades, such as a machette. Furthermore, as the guide is ground, the material of the guide is deposited on the grinding surface, which may load the stone so that it loses its utility. This is especially true of aluminum guides which are in common use.

SUMMARY OF THE INVENTION

It is accordingly an object of the invention to provide sharpening guides for manual sharpening of blades that will provide for sharpening or honing at a preset angle. It is another object of the invention to provide a guide useful for blades of different lengths and widths and for curved blades. It is yet another object to provide a guide that does not load or damage the grinding agent.

The sharpening guide of the invention comprises elongate straight or curved strips having a wedge shaped cross section with a pressure sensitive adhesive on one leg of the wedge for removably adhering to one face of the blade. The other leg of the wedge is arranged for resting flat on the face of the sharpening stone to present the blade edge to the stone at the correct angle for sharpening. Appropriate lengths of the strip may be broken or cut off, the protective cover removed from the adhesive, and the strip portions stuck onto the blade for providing a guide for correct sharpening of one side of the blade. The guide is then pulled off the blade, applied to the second side of the blade, and the process repeated. The strip may be discarded after use, before it has been appreciably ground down. Various means may be provided to reduce loading of the stone, including a reduced surface area in contact with the stone, a strip material that is not readily abraded by the stone, and a strip material readily washed off the stone. The strip is provided with a tab projection so that it may be readily pulled off the blade.

BRIEF DESCRIPTION OF THE DRAWINGS

FIG. 1 is a perspective view of the invention in place on a machette.

FIG. 2 is a sectional view taken through line 2—2 of FIG. 1, with sharpening stone shown in phantom.

FIG. 3 is a perspective view of the guide with a portion of the adhesive exposed.

FIG. 4 is an end view of an alternative embodiment of the invention.

DETAILED DESCRIPTION OF PREFERRED EMBODIMENTS

Referring now first to FIGS. 1-3, the guide of the invention comprises elongate strips, both straight 1 and curved 2. The strip, whether curved or straight, has a wedge-shaped cross section formed by a first flat face 3 provided with a pressure sensitive adhesive 4, and a second flat face 5 which form a fixed angle 6 between the two faces. The angle may be between 10 and 30 degrees. When the protective cover strip 7 or release paper is removed from the adhesive, the strip is affixed to a first face 8 of the knife blade 9. The second flat face 5 of the strip is laid flat on the sharpening stone 10, and rubbed with a grinding motion. The knife edge 11 is guided at the correct angle to the stone so that the edge is ground at the correct angle as the guide and blade in combination are rubbed on the stone. To grind the second side of the edge, the strip is pulled free of the blade by inserting a finger nail under the lifting tab 12. The tab 12 extends from the back edge 16 that forms the third leg of a triangle with legs 3 and 5. The strip is then stuck on the opposite face of the blade and the second face of the edge sharpened in the same fashion as described above. Suitable lengths of curved and straight portions are cut or broken off. The exact length is not critical, as long as the gaps between portions of strip are not as long as the width of the sharpening stone. The curved strip is provided in curves of various radii so that a portion may be selected to correspond to the curvature of a particular blade. It may be provided with various angles for particular applications. The strip is preferrably formed of an inexpensive material so that it may be discarded after one use before it has been appreciably ground by the stone. The straight strip is most economically formed by extrusion. The curved strip is formed by injection molding. The material of construction may be of a very hard material such as ceramic so that it is not ground down. Alternatively, the material of construction may be a lubricous plastic such as polyolefin. An optional construction material is one that is readily dissolved by a suitable solvent so that any loading of the grindstone may be readily washed away. An example of this is polyvinyl alcohol plastic, which is insoluble in a petroleum or silicone lubricant used for grinding, but is readily dissolved in water.

An alternative embodiment is shown in FIG. 4, in which the wedge-shaped strip 13 is comprised of a first flat face 3 coated with adhesive 4. The second face 14 forming the angle 6 is provided with indentations 15 that may be in the shape of troughs running the length of the strip. These have the effect of reducing the total amount of material used and also the area in contact with the abrading stone so that the total amount of material ground away and loading the stone is reduced.

The guide is light, inexpensive, readily applied, and disposable. It may be made of recycled plastic and it may be degradable so that it does not present disposal problems. The polyvinyl alcohol embodiment will dissolve away in a few rainstorms.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A sharpening guide for grinding a blade having two broad surfaces against an abrading surface at a fixed angle, said guide comprising:

A) an elongate strip having a uniform cross section in the shape of a wedge;

B) a first broad face of said wedge having an adhesive means thereon for removably affixing to one of said broad surfaces of said blade;

C) a second broad face of said wedge arranged at said fixed angle relative to said first broad face, said second broad face arranged to be held flat against an abrading surface while said guide is removably affixed to said blade to thereby grind said blade at said fixed angle relative to said broad surface;

D) a narrow face of said wedge joining said first and second broad faces; and

E) release means extending from said narrow face for facilitating removal of said guide from said blade after grinding.

2. The guide according to claim 1 further comprising a removable membrane protectively covering said adhesive means.

3. The guide according to claim 2, in which said second broad face is provided with a plurality of indentations therein to reduce the surface area of said second broad face in contact with said abrading surface.

4. The guide according to claim 3, in which said indentations are in the form of parallel troughs.

5. The guide according to claim 2, in which said elongate strip is straight.

6. The guide according to claim 2, in which said elongate strip is curved.

7. The guide according to claim 2, in which said fixed angle is between ten and thirty degrees.

8. The guide according to claim 2, in which said strip is formed of a hard abrasion-resistant material.

9. The guide according to claim 2, in which said strip is formed of a lubricous plastic material.

10. The guide according to claim 9, in which said material is polyolefin.

11. The guide according to claim 2, in which said strip is formed of a material soluble in a solvent for readily cleaning said abrading surface after use.

12. The guide according to claim 11, in which said material is polyvinyl alcohol plastic for ready cleaning with water and for ready degradation after disposal.

* * * * *